US011199121B2

(12) United States Patent
Sawanishi et al.

(10) Patent No.: US 11,199,121 B2
(45) Date of Patent: Dec. 14, 2021

(54) EXHAUST DEVICE

(71) Applicant: FUTABA INDUSTRIAL CO., LTD., Okazaki (JP)

(72) Inventors: Yuki Sawanishi, Okazaki (JP); Naoki Matsumoto, Okazaki (JP); Makoto Hisaike, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 228 days.

(21) Appl. No.: 16/722,430

(22) Filed: Dec. 20, 2019

(65) Prior Publication Data

US 2020/0224577 A1 Jul. 16, 2020

(30) Foreign Application Priority Data

Jan. 11, 2019 (JP) ..... JP2019-003637

(51) Int. Cl.
*F01N 13/08* (2010.01)
*F01N 13/18* (2010.01)
*F01N 1/02* (2006.01)

(52) U.S. Cl.
CPC ..... *F01N 13/08* (2013.01); *F01N 13/1844* (2013.01); *F01N 1/02* (2013.01); *F01N 2450/20* (2013.01)

(58) Field of Classification Search
CPC ..... F01N 13/08; F01N 13/1844; F01N 1/02; F01N 2450/20
USPC ..... 248/58; 181/212
See application file for complete search history.

(56) References Cited

U.S. PATENT DOCUMENTS 4,116,411 A * 9/1978 Masuda ..... F01N 13/1822 180/89.2
5,890,685 A * 4/1999 Takahashi ..... B60K 13/04 248/74.3
6,402,119 B1 * 6/2002 Miska ..... B60K 13/04 248/58
6,758,300 B2 * 7/2004 Kromis ..... B60K 13/04 180/296
6,851,506 B2 * 2/2005 Bovio ..... B60K 13/04 180/296
7,571,880 B2 * 8/2009 Perez ..... F01N 13/1822 248/58

(Continued)

FOREIGN PATENT DOCUMENTS

JP 2002240578 A 8/2002
JP 2005155551 A 6/2005

(Continued)

*Primary Examiner* — Tom P Duong
(74) *Attorney, Agent, or Firm* — Withrow & Terranova, P.L.L.C.; Vincent K. Gustafson

(57) ABSTRACT

An exhaust device includes a supporting component and an exhaust component. The supporting component is configured to support the exhaust component. The supporting component includes a rod and a bracket. The bracket is supported from above by the rod. The exhaust component includes a joining target portion. The joining target portion includes a first joining surface and a second joining surface, to which the bracket is joined. An intermediate surface, which is between the first joining surface and the second joining surface, is provided with a reinforcing portion that reinforces the intermediate surface.

10 Claims, 9 Drawing Sheets

(56) References Cited

U.S. PATENT DOCUMENTS

| | | | | |
|---|---|---|---|---|
| 7,750,335 | B2 * | 7/2010 | Clevenger | H01L 45/122 257/4 |
| 9,840,960 | B2 * | 12/2017 | Lampe | F01N 13/1805 |
| 2003/0155169 | A1 * | 8/2003 | Kromis | B60K 13/04 180/309 |
| 2005/0115764 | A1 | 6/2005 | Mabuchi et al. | |
| 2005/0184201 | A1 * | 8/2005 | Komitsu | B60K 13/04 248/58 |
| 2015/0090518 | A1 * | 4/2015 | Yoshida | B60K 15/063 180/309 |
| 2017/0036727 | A1 * | 2/2017 | Shigihara | B62K 11/04 |
| 2018/0291793 | A1 * | 10/2018 | Shende | F16B 7/04 |

FOREIGN PATENT DOCUMENTS

| | | | |
|---|---|---|---|
| JP | 4432705 | B2 | 3/2010 |
| JP | 2010138784 | A | 6/2010 |
| JP | 2013248973 | A | 12/2013 |

* cited by examiner

EXHAUST DEVICE

CROSS-REFERENCE TO RELATED APPLICATIONS

This application claims the benefit of Japanese Patent Application No. 2019-3637 filed on Jan. 11, 2019 with the Japan Patent Office, the entire disclosure of which is incorporated herein by reference.

BACKGROUND

The present disclosure relates to an exhaust device in which a supporting component supports an exhaust component that causes exhaust gas of a vehicle to flow downstream.

Known is a technique to support an exhaust component of a vehicle from above by a bracket or the like. A supporting bracket disclosed in Japanese Unexamined Patent Application Publication No. 2010-138784 is mounted on an upper surface of a muffler. The supporting bracket is joined to, in an upper part thereof, a rod that extends transversely. The rod is inserted through a supporting rubber. Further, the supporting rubber receives therein another rod that is joined to a vehicle body. The supporting bracket is supported from above by the supporting rubber and the aforementioned rods.

SUMMARY

In this regard, there may be a case where stiffness of a joining portion of the exhaust component to the supporting bracket is low. In this case, the joining portion has concentrated stress and has a risk of being damaged and/or vibrating during travel of a vehicle. In particular, as a length of the rod, which is provided to the supporting bracket, increases, the joining portion has further increased stress. Consequently, damage and/or vibration of the coupling portion is likely to occur. Further, as the length of the rod increases, the rod has a decreased resonance frequency. Consequently, the supporting bracket and the rod resonate with each other during the travel of the vehicle, which has a risk of causing noise.

In one aspect of the present disclosure, it is desirable to more advantageously support the exhaust component.

One aspect of the present disclosure is an exhaust device that includes an exhaust component that causes exhaust gas of a vehicle to flow downstream and a supporting component that supports the exhaust component. The supporting component includes a rod and a bracket. The rod is a bar-shaped component and is configured to be provided to the vehicle. The bracket is configured to be supported from above by the rod. The exhaust component includes a joining target portion. The joining target portion includes a first joining surface and a second joining surface, each of which is a portion to which the bracket is joined in an outer surface of the exhaust component. The joining target portion also includes an intermediate surface that is provided between the first joining surface and the second joining surface. The bracket includes a base, a first wall, a second wall, a first joining portion, and a second joining portion. The base is a plate-shaped portion and is configured to be joined to the rod. The first wall and the second wall each are a plate-shaped portion. The first wall and second wall face each other and are configured to extend downward from the base. The first joining portion is provided to an edge of the first wall and is joined to the first joining surface. The second joining portion is provided to an edge of the second wall and is joined to the second joining surface. The intermediate surface includes a reinforcing portion that reinforces the intermediate surface.

With the aforementioned configuration, the intermediate surface between the first joining surface and the second joining surface of the joining target portion of the exhaust component is reinforced by the reinforcing portion. As a result, the joining target portion has improved stiffness, which can inhibit stress from being locally applied on the joining target portion. Consequently, this inhibits the joining target portion from being damaged and/or from vibrating during travel of the vehicle. Further, as a result of improvement in stiffness of the joining target portion, the bracket and the rod are less likely to resonate with each other, thus inhibiting noise. Accordingly, it is possible to more advantageously support the exhaust component.

In one aspect of the present disclosure, the first wall and the second wall may be oblique with respect to each other such that a distance between the first wall and the second wall increases toward the opposite of the base.

With the aforementioned configuration, it is possible to improve stiffness of the bracket in comparison with a case where the first wall and the second wall are parallel to each other.

In one aspect of the present disclosure, the first joining portion and the second joining portion each may have an elongated plate shape. Further, the first joining portion and the second joining portion may extend such that a distance between the first joining portion and the second joining portion increases from respective first ends to respective second ends of the first joining portion and the second joining portion.

With the aforementioned configuration, it is possible to further lengthen an area where each of the first joining portion and the second joining portion, and the joining target portion contact each other when the first joining portion and the second joining portion each are joined to the joining target portion. This is so, in comparison with a case where the first joining portion and the second joining portion have a constant distance therebetween. Thus, it is possible to improve joining stiffness between each of the first joining portion and the second joining portion, and the joining target portion.

In one aspect of the present disclosure, the reinforcing portion may protrude out of the first joining surface and the second joining surface.

With the aforementioned configuration, the joining target portion has improved stiffness.

In one aspect of the present disclosure, the first joining surface and the second joining surface may be recessed in the outer surface of the exhaust component.

With the aforementioned configuration, the joining target portion has improved stiffness.

In one aspect of the present disclosure, the reinforcing portion may be recessed from the first joining surface and the second joining surface.

With the aforementioned configuration, the joining target portion has improved stiffness.

In one aspect of the present disclosure, the joining target portion may have a curved plate shape.

With the aforementioned configuration, the joining target portion has improved stiffness.

In one aspect of the present disclosure, a specified shape of a surface may be determined as a reference shape. The first joining surface and the second joining surface may be recessed in the outer surface of the exhaust component.

Also, the first joining surface and the second joining surface each may include a surface that has the same or approximately the same shape as the reference shape. The first joining portion may be joined to the first joining surface in a state where the first joining portion is brought into surface contact with the first joining surface. The second joining portion may be joined to the second joining surface in a state where the second joining portion is brought into surface contact with the second joining surface.

With the aforementioned configuration, the first joining surface and the second joining surface are configured to be recessed in the outer surface of the exhaust component. Therefore, it is possible to appropriately determine respective shapes of the first joining surface and the second joining surface without being affected by a shape of an exhaust component. The first joining surface and the second joining surface each include the surface that has the same or approximately the same shape as the reference shape. Therefore, the first joining portion and the second joining portion, each of which has a surface having the same or approximately the same shape as the reference shape, allow themselves to contact the first joining surface and the second joining surface. Accordingly, it is possible to support the exhaust component, without being affected by the shape of the exhaust component, by the bracket that includes the first joining portion and the second joining portion that correspond to the reference shape. In other words, it is possible to support a variety of exhaust components by a standardized bracket, thus facilitating standardization of the supporting component.

In one aspect of the present disclosure, the first joining portion and the second joining portion may be plane-symmetrical or approximately plane-symmetrical with each other with respect to a reference surface. The reference surface is positioned between the first wall and the second wall. Further, the first wall and the second wall may be plane-symmetrical or approximately plane-symmetrical with each other with respect to the reference surface.

With the aforementioned configuration, the bracket can be easily manufactured.

In one aspect of the present disclosure, the exhaust component may be a muffler. The first joining surface and the second joining surface may be provided upward of an opening that communicates an inside of the muffler and an outside of the muffler together.

Respective peripheral portions of an inlet and an outlet of the muffler have improved stiffness with the help of a burring or the like that is provided to the inlet and the outlet. As a result, the joining target portion has improved stiffness with the aforementioned configuration.

BRIEF DESCRIPTION OF THE DRAWINGS

Embodiments of the present disclosure will be described hereinafter with reference to the accompanying drawings, in which.

DETAILED DESCRIPTION OF EXEMPLARY EMBODIMENTS

An embodiment of the present disclosure is not limited to embodiments described below and can be practiced in any various forms that fall within the technical scope of the present disclosure.

First Embodiment

[1. Entire Configuration]

Figure 1:
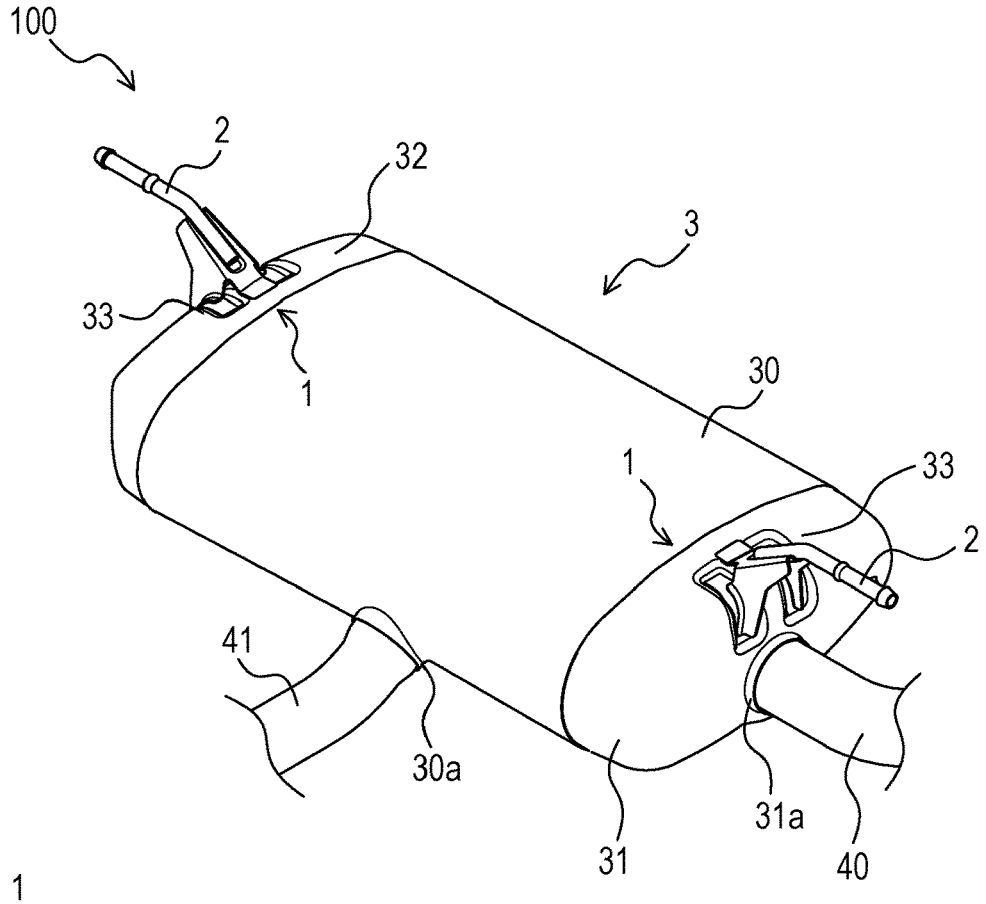
FIG. 1 is a perspective view of an exhaust device of a first embodiment.
Figure 2:
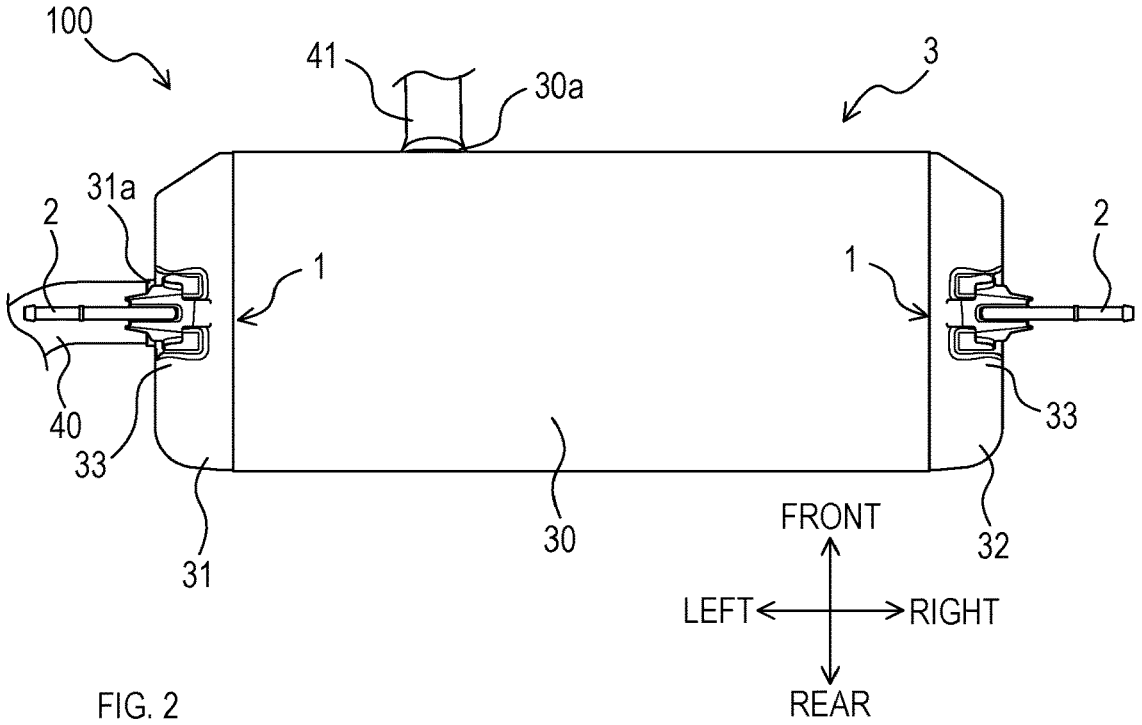
FIG. 2 is a plan view of the exhaust device of the first embodiment.
Figure 3:
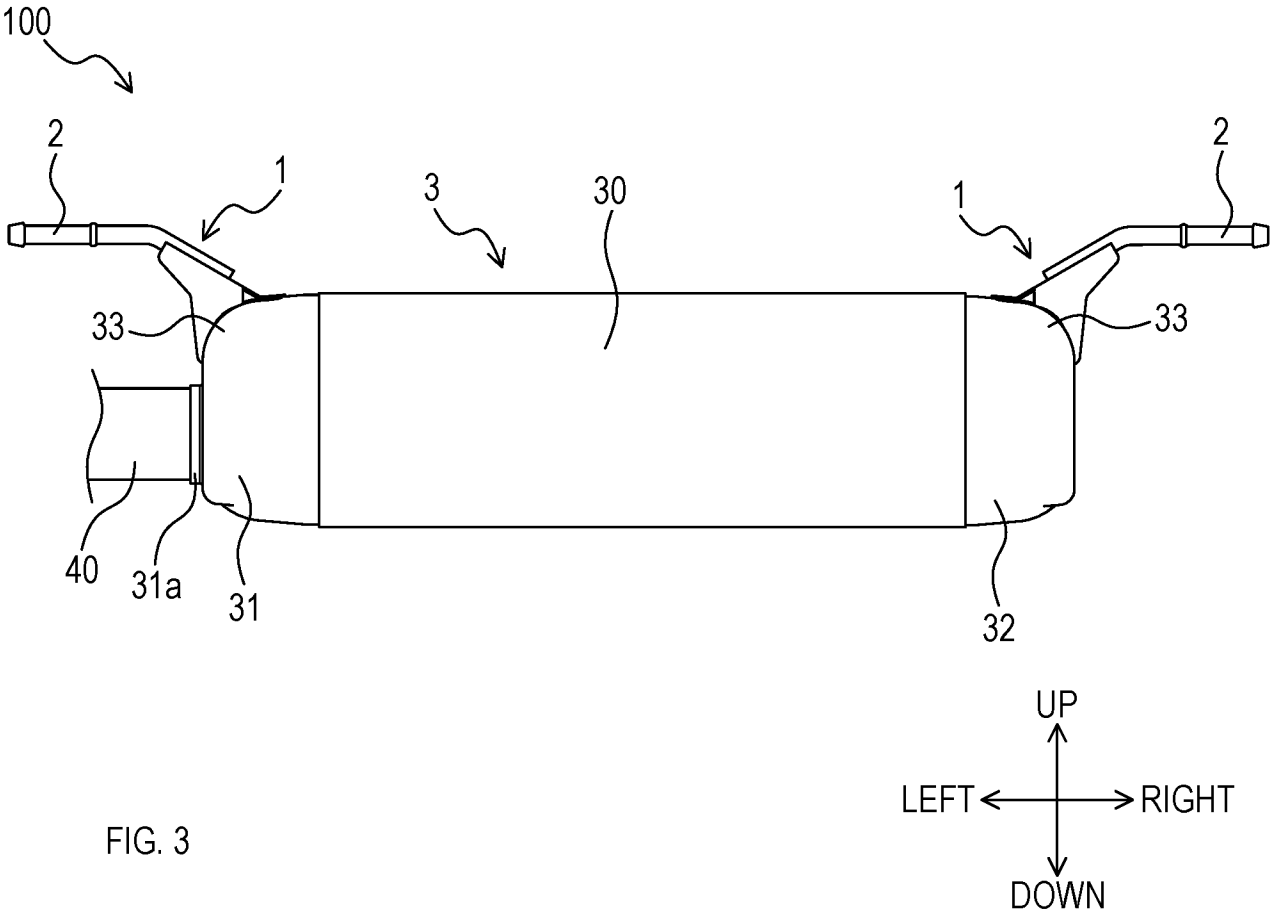
FIG. 3 is a rear view (in other words, back view) of the exhaust device of the first embodiment.

An exhaust device 100 of a first embodiment includes a supporting component 1 and a muffler 3 (see, FIGS. 1 to 3). The muffler 3 is one example of an exhaust component. The supporting component 1 includes a rod 2 and a bracket 10 (see, FIGS. 4 to 10), which are described below. The supporting component 1 is provided to the muffler 3 to support the muffler 3.

[2. Configuration of Muffler]

The muffler 3 is mounted in a vehicle and causes exhaust gas from an engine to flow downstream to the outside of the vehicle (see, FIGS. 1 to 3). The muffler 3 has a columnar shape that extends along right-left directions. The muffler 3 has an approximately oval section that is perpendicular to the right-left directions. Further, directions along a longitudinal axis of the section of the muffler 3 are front-rear directions and directions along a crosswise axis of the section of the muffler 3 are up-down directions. The muffler 3 is mounted in the vehicle with its up-down directions corresponding to or approximately corresponding to a vertical direction (of the vehicle). However, the front-rear directions and right-left directions of the muffler 3 do not necessarily correspond to front-rear directions and right-left directions of the vehicle, respectively. The muffler 3 is appropriately arranged without being affected by the front-rear directions and right-left directions of the vehicle.

The muffler 3 is coupled to an upstream pipe 41 and to a downstream pipe 40. The exhaust gas flows into the muffler 3 from the upstream pipe 41 and flows out to the downstream pipe 40 after passing through the muffler 3. The muffler 3 comprises a shell 30, a first end plate 31, and a second end plate 32.

The shell 30 is a cylindrical member that has an approximately oval section, the approximately oval section being perpendicular to the right-left directions. An inlet 30*a* is provided in a front lower portion of the shell 30. The inlet 30*a* is provided to communicate the inside and the outside of the muffler 3 together. The inlet 30*a* is coupled to the upstream pipe 41.

The first end plate 31 and the second end plate 32 are plate-shaped portions that provide sealing to both ends of the shell 30. Here, the first end plate 31 is arranged in the left side of the shell 30 and the second end plate 32 is arranged in the right side of the shell 30. Further, the first end plate 31 and the second end plate 32 each are curved to protrude outward at the center thereof along the up-down directions. In other words, the first end plate 31 and the second end plate 32 each have a C-shaped section along the right-left directions. In addition, respective rear corners of the first end plate 31 and the second end plate 32 are formed to be round. Respective front corners of the first end plate 31 and the second end plate 32 are formed to have oblique surfaces.

The first end plate 31 is provided with an outlet 31*a* at the center of the first end plate 31 along the front-rear directions. The outlet 31*a* is provided to communicate the inside and the outside of the muffler 3 together. The outlet 31*a* is positioned slightly lower than the center of the first end plate 31 along the up-down directions is. The outlet 31*a* is coupled to the downstream pipe 40. Further, the outlet 31*a* has a burring 31*b* formed thereto, the burring 31*b* being joined to the downstream pipe 40 (see, FIGS. 4 and 5).

At the center along the front-rear directions, the first end plate 31 and the second end plate 32 each are joined to a bracket 10, which is a part of the supporting component 1. As described above, the first end plate 31 and the second end plate 32 each are curved to protrude outward at the center thereof along the up-down directions. The bracket 10 is joined to an upper side of the curved portion in each of the first end plate 31 and the second end plate 32. Hereinafter, a portion, to which the bracket 10 is joined in each of the first end plate 31 and the second end plate 32, is described as a joining target portion 33.

[3. Configuration of Rod]

The bracket 10 is joined to a rod 2, which is a bar-shaped component. The bracket 10 is supported from above by the rod 2. More specifically, the rod 2 is a bent cylindrical component and comprises a main body 20, a bent portion 21, a leading end 22, and a protrusion 23 (see, FIGS. 4, 5, 7, and 10).

The main body 20 extends linearly along horizontal or approximately horizontal directions. The main body 20 is provided with the protrusion 23 at an approximate center of the main body 20, the protrusion 23 protruding from an outer circumferential surface of the main body 20. The protrusion 23 encircles the outer circumferential surface of the main body 20.

The leading end 22 is provided to one end of the rod 2 that is situated closer to the main body 20 (than the other end of the rod 2 is). The leading end 22 has a diameter that is larger than the diameter of the main body 20. The leading end 22 is tapered toward the one end of the rod 2.

The bent portion 21 extends obliquely downward and linearly from an end of the main body 20 that is situated opposite to the leading end 22. The bent portion 21 is joined to a base 11 of the bracket 10 of the exhaust device 100. Details of the base 11 are described below.

The rod 2 is mounted in the vehicle with the main body 20 being inserted into a supporting rubber, which is not shown. Specifically, a portion between the leading end 22 and the protrusion 23 of the main body 20 (hereinafter, referred to as an inserted portion 20*a*) is inserted into the supporting rubber. The supporting rubber receives another rod that is joined to the vehicle. The rod 2 is supported from above by the supporting rubber and the other rod.

[4. Respective Configurations of Supporting Component and Exhaust Component]

The supporting component 1 supports, from above, the exhaust component (the muffler 3, in one example) that causes the exhaust gas of the vehicle to flow downstream. The supporting component 1 comprises the above-described rod 2 and the bracket 10 that is supported from above by the rod 2 (see, FIGS. 7 to 10).

Figure 4:
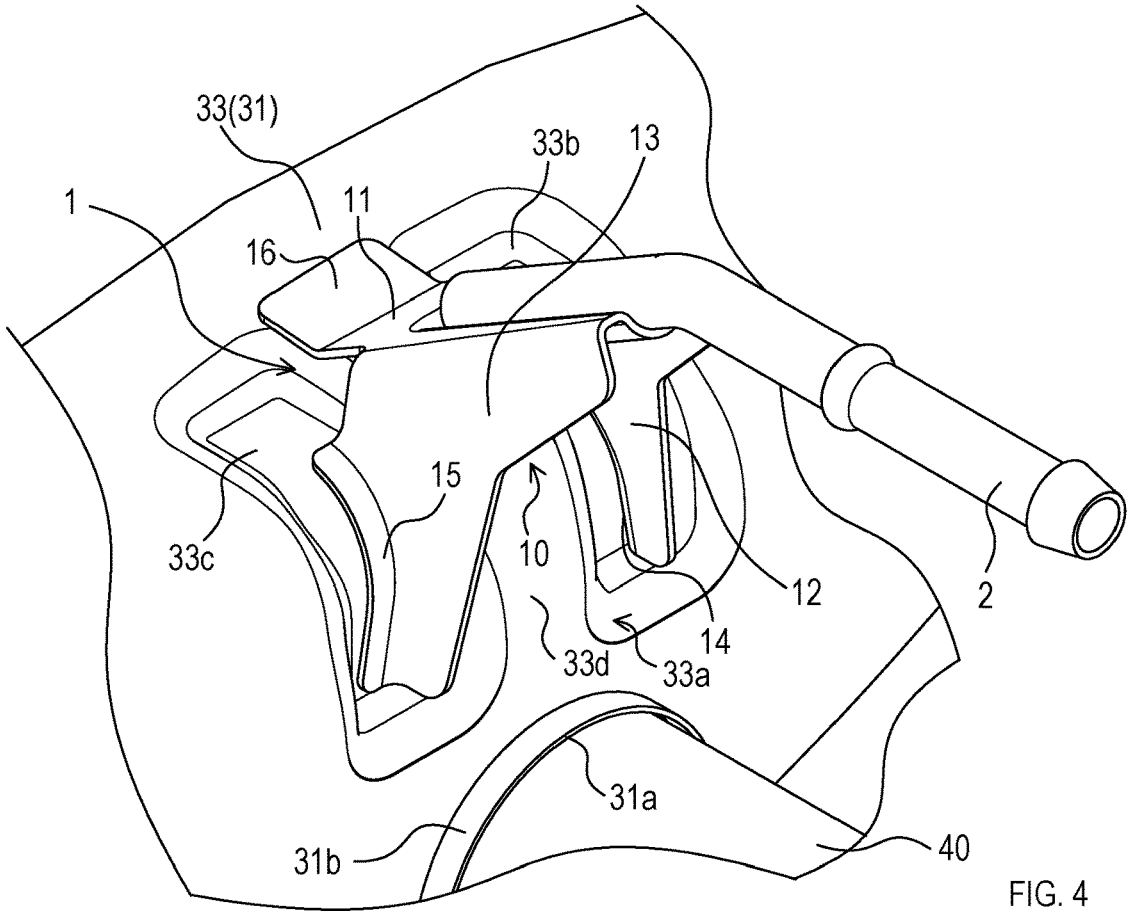
FIG. 4 enlarges a perspective view of a portion of a first end plate of the exhaust device of the first embodiment, the portion being provided with a supporting component.
Figure 5:
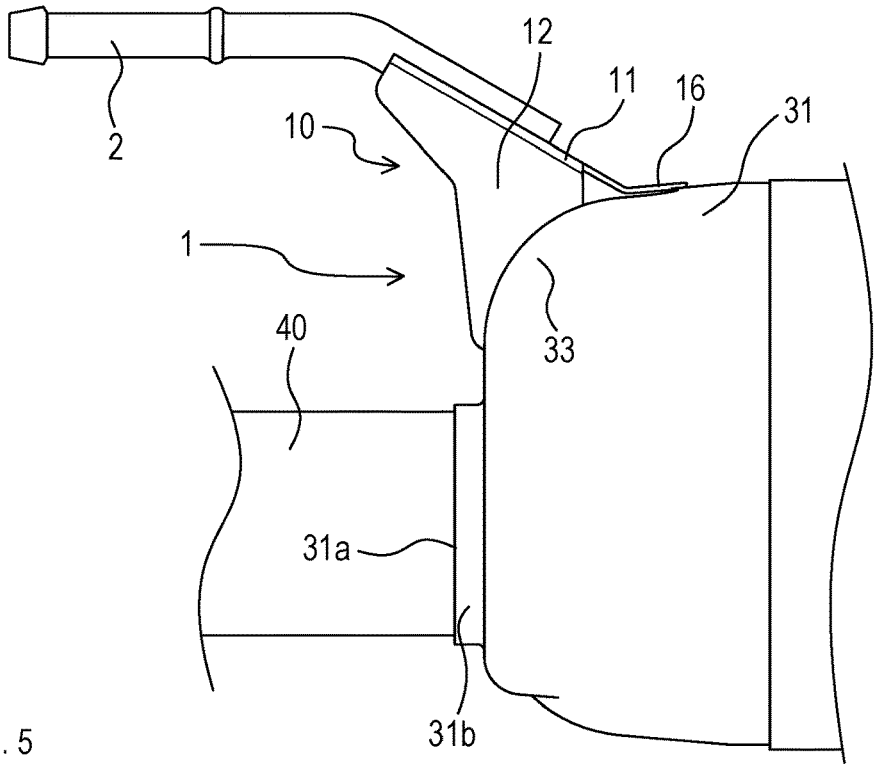
FIG. 5 enlarges a rear view of the portion of the first end plate of the exhaust device of the first embodiment, the portion being provided with the supporting component.
Figure 6:
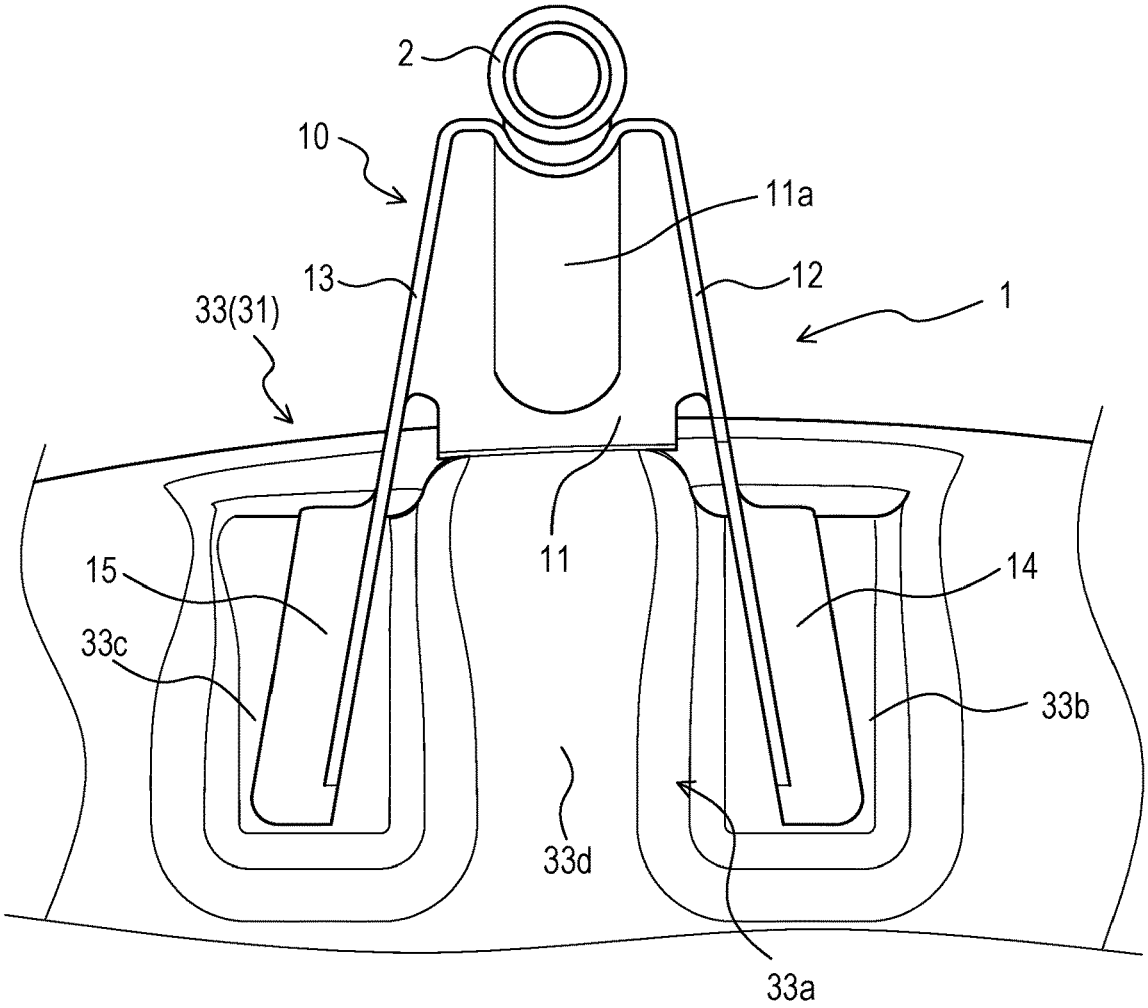
FIG. 6 enlarges a front view of the portion of the first end plate of the exhaust device of the first embodiment, the portion being provided with the supporting component.
Figure 7:
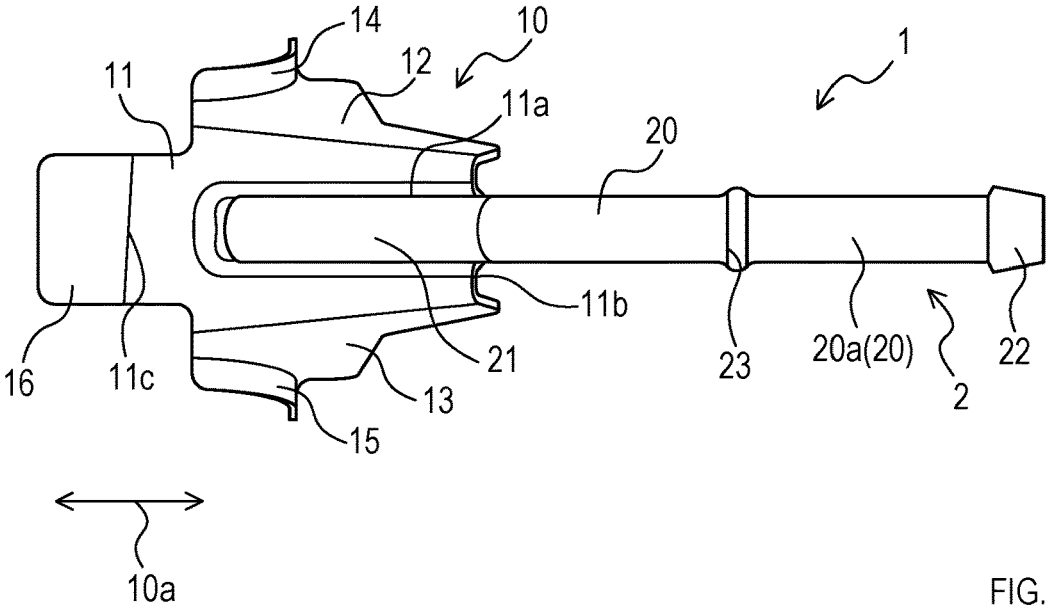
FIG. 7 is a plan view of the supporting component of the exhaust device of the first embodiment.
Figure 8:
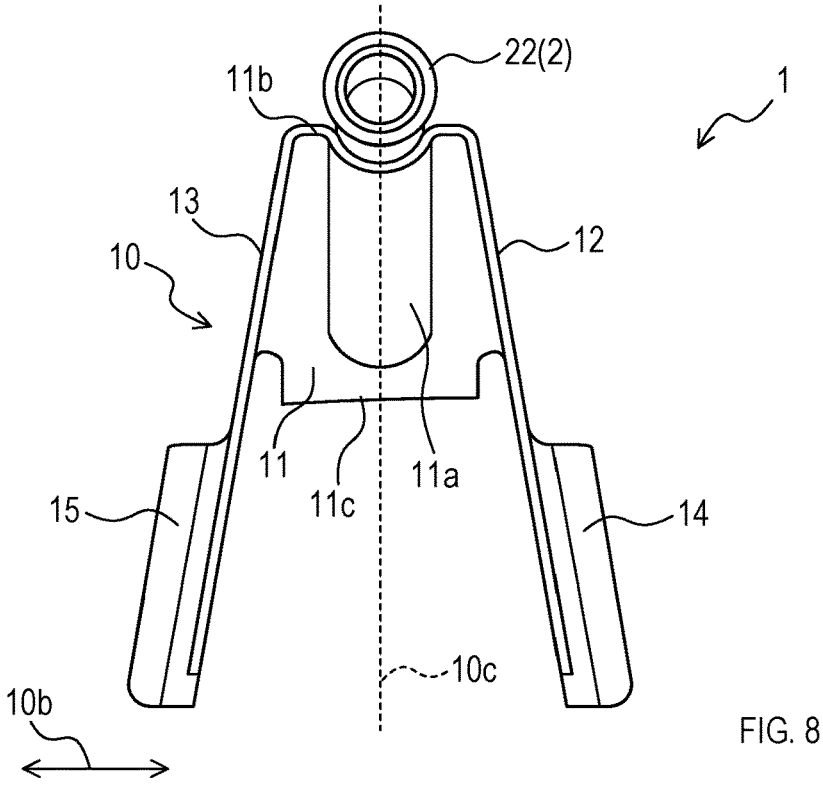
FIG. 8 is a front view of the supporting component of the exhaust device of the first embodiment.
Figure 9:
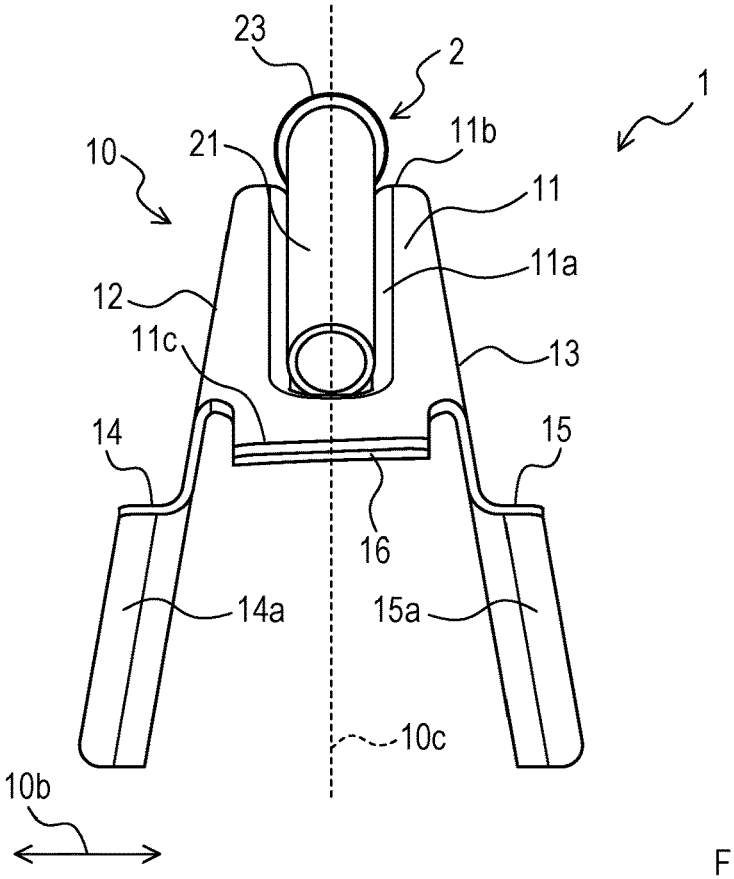
FIG. 9 is a back view of the supporting component of the exhaust device of the first embodiment.
Figure 10:
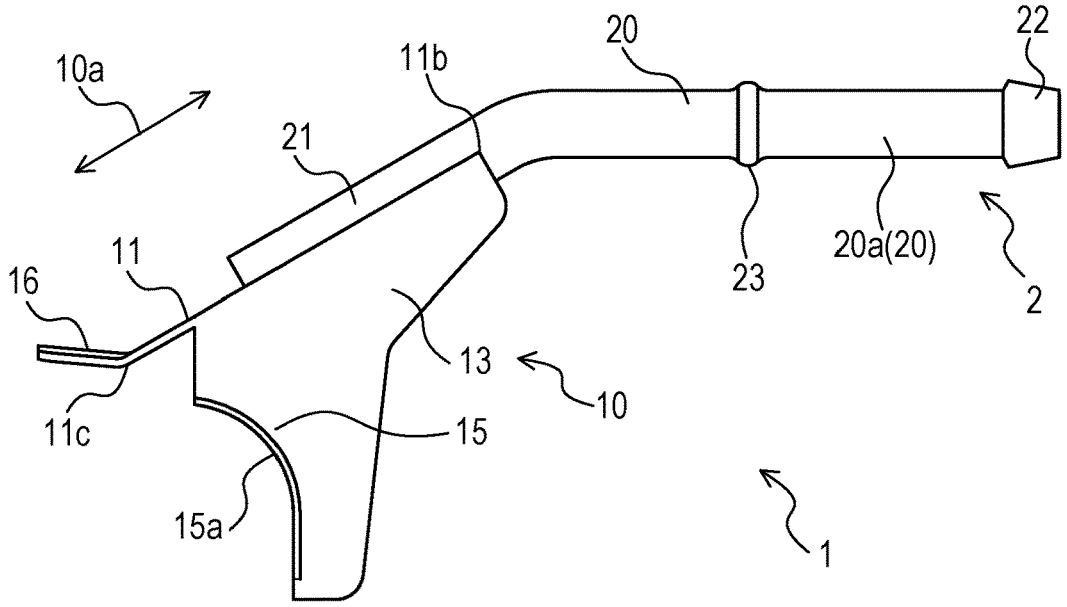
FIG. 10 is a side view of the supporting component of the exhaust device of the first embodiment.

The muffler 3 comprises the joining target portion 33 that includes at least a portion of each of the first end plate 31 and the second end plate 32 (see, FIGS. 4 to 6). Here, the joining target portion 33 provided to the first end plate 31 is positioned upward of the outlet 31*a*.

[5. Configuration of Bracket]

The bracket 10 is an elongated component that extends along extending directions 10*a*. The bracket 10 comprises the base 11, a first wall 12, a second wall 13, first to third joining portions 14 to 16 (see, FIGS. 7 to 10).

The base 11 is an elongated and flat plate-shaped portion that extends along the extending directions 10*a*. The base 11 is widened in directions along its width axis (hereinafter, referred to as a width directions 10*b*), the width directions 10*b* being perpendicular to the extending directions 10*a*. Hereinafter, one end of the base 11 along the extending directions 10*a* is described as a first end 11*b* and the other end of the base 11 along the extending directions 10*a* is described as a second end 11*c*. The base 11 and the bent portion 21 of the rod 2 are joined together.

Specifically, an upper side surface of the base 11 is provided with a groove 11*a*. The groove 11*a* is positioned at the center of the base 11 along the width directions 10*b* and extends from the first end 11*b* of the base 11 along the extending directions 10*a*. Further, the groove 11*a* is shaped to correspond to the outer circumferential surface of the bent portion 21 of the rod 2. The groove 11*a* has a semi-circular section that is perpendicular to the extending directions 10*a*.

The bent portion 21 is joined to (welded to, in one example) the groove 11*a*. The bent portion 21, which is joined to the base 11, extends outward of the base 11 from the first end 11*b* of the base 11 along the extending directions 10*a*. As described above, in a case where the rod 2 is supported by the supporting rubber or the like, the bent portion 21 is oblique with respect to the main body 20 of the rod 2 that extends along the horizontal or approximately horizontal directions. Thus, the bracket 10 is supported from above with the base 11 being oblique with respect to the horizontal directions (see, FIGS. 1 to 5).

The first wall 12 and the second wall 13 are flat plate-shaped portions that extend downward from respective edges of the base 11 that face each other across the groove 11*a*. The first wall 12 and the second wall 13 each are a portion shaped in an approximately triangle that is widened along the extending directions 10*a*. The first wall 12 and the second wall 13 are positioned at both sides of the bent portion 21 and face each other along the width directions 10*b*. Further, the first wall 12 and the second end 13 are oblique with respect to each other such that a distance between the first wall 12 and the second wall 13 increases toward the opposite of the base 11. Here, a surface that passes the center of the base 11 along the width directions 10*b* and is perpendicular to the base 11 is a reference surface 10*c*. The first wall 12 and the second wall 13 are oblique with respect to the reference surface 10*c* such that a distance between the reference surface 10*c* and the first wall 12 and a distance between the reference surface 10*c* and the second wall 13 increase toward the opposite of the base 11. In addition, the first wall 12 and the second wall 13 are formed to be plane-symmetrical or approximately plane-symmetrical with each other with respect to the reference surface 10*c* as the center.

The first joining portion 14 and the second joining portion 15, respectively, have elongated plate shapes and are provided to edges of the first wall 12 and the second wall 13, the edges being situated closer to the second end 11*c* than to the first end 11*b*. More specifically, the edge of the first wall 12 forms one side of the approximate triangle, in which the first wall 12 is shaped. The edge of the second wall 13 forms one side of the approximate triangle, in which the second wall 13 is shaped. The first joining portion 14 and the second joining portion 15 are arcuately curved. In addition, the first joining portion 14 and the second joining portion 15 extend to be distanced from the base 11. The first joining portion 14 and the second joining portion 15 extend such that a distance between the first joining portion 14 and the second joining portion 15 increases from respective first ends to respective second ends thereof, the respective first ends being positioned closer to the base 11 than the respective second ends are. The first joining portion 14 and the second joining portion 15 are formed to be plane-symmetrical or approximately plane-symmetrical with each other with respect to the reference surface 10*c* as the center.

Here, a specified shape of a surface is defined as a reference shape. In the first embodiment, the reference shape is, in one example, a shape of an elongated surface that is arcuately curved. The surface having the reference shape may be curved in a constant or approximately constant curvature from a first and to a second end of the surface. Other than the aforementioned, the reference shape may be, for example, a shape of a bent surface or a shape of a plane.

In addition, the first joining portion 14 and the second joining portion 15 include surfaces that are positioned closer to the second end 11*c* of the base 11 than to the first end 11*b*. The surface of the first joining portion 14 and the surface of the second joining portion 15 are defined as a contact surface 14*a* and a contact surface 15*a*, respectively. The first joining portion 14 and the second joining portion 15, respectively, are configured such that the contact surfaces 14*a* and 15*a* correspond to or approximately correspond to the reference shape. The first joining portion 14 and the second joining portion 15, respectively, are joined to (welded to, in one example) a first joining surface 33*b* and a second joining surface 33*c* of the joining target portion 33. Here, the contact surface 14*a* of the first joining portion 14 and the contact surface 15*a* of the second joining portion 15*a*, respectively, are brought into surface contact with the first joining surface 33*b* and the second joining surface 33*b*.

The third joining portion 16 has an approximately rectangular shape and is provided to the second end 11*c* of the base 11. The third joining portion 16 is joined to (welded to, in one example) the joining target portion 33 between the first joining surface 33*b* and the second joining surface 33*c*.

[6. Configuration of Joining Target Portion]

The joining target portion 33 has a curved plate shape and is positioned in an upper part of the center of each of the first end plate 31 and the second end plate 32 of the muffler 3 along the front-rear directions (see, FIGS. 4 to 6). The joining target portion 33 comprises a first joining surface 33*b*, a second joining surface 33*c*, and an intermediate surface 33*a*.

The first joining surface 33*b* and the second joining surface 33*c* each are configured to be recessed in an outer surface of the joining target portion 33 (in other words, an outer surface of the first end plate 31 or the second end plate 32). Further, the first joining surface 33*b* and the second joining surface 33*c* each are configured as an elongated surface that extends along the up-down directions. The first joining surface 33*b* and the second joining surface 33*c* each include a surface that has the same or approximately the same shape as the above-described reference shape. The first joining surface 33*b* and the second joining surface 33*c*, respectively, are joined to the contact surface 14*a* of the first joining portion 14 and the contact surface 15*a* of the second joining portion 15 of the bracket 10. Here, as described above, the contact surfaces 14*a* and 15*a* are the same or approximately the same in shape as the reference shape. Therefore, the contact surfaces 14*a* and 15*a*, respectively, are brought into surface contact with the first joining surface 33*b* and the second joining surface 33*c* when the first joining surface 33*b* and the second joining surface 33*c*, respectively, are joined to the first joining portion 14 and the second joining portion 15.

The intermediate surface 33*a* is a portion in the outer surface of the joining target portion 33 between the first joining surface 33*b* and the second joining surface 33*c*. The intermediate surface 33*a* is provided with a reinforcing portion 33*d* that reinforces the intermediate surface 33*a*. The reinforcing portion 33*d* helps the joining target portion 33 to have improved stiffness. In the first embodiment, in one example, the reinforcing portion 33*d* is configured as a rib-like portion that protrudes out of the first joining surface 33*b* and the second joining surface 33*c*.

Figure 11:
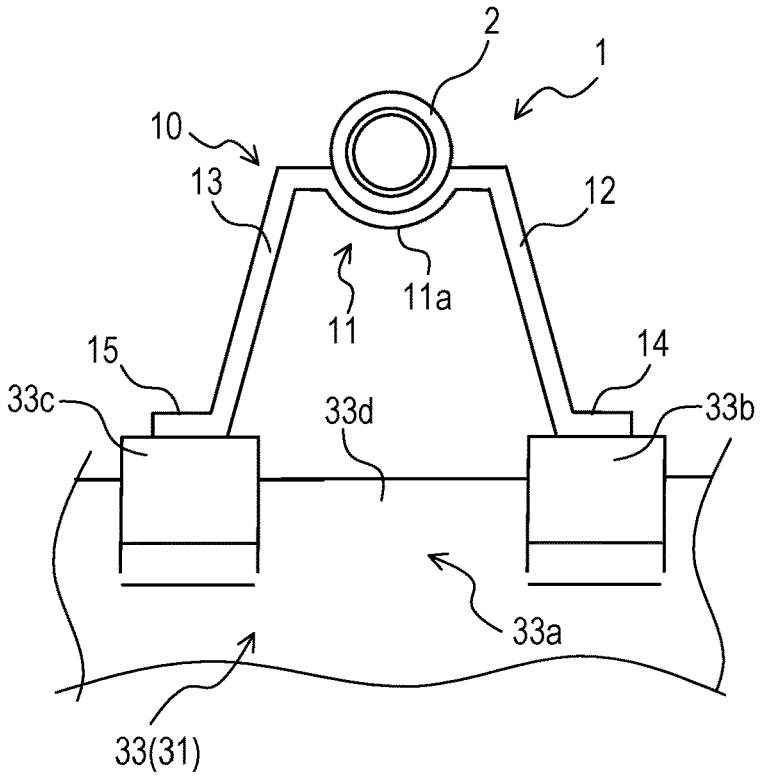
FIG. 11 is a front view of a portion of an exhaust device of a modified example, the portion being provided with a supporting component.

However, the reinforcing portion 33*d* is not limited to the above-described configuration. For example, the reinforcing portion 33*d* may be recessed inward of the first joining surface 33*b* and the second joining surface 33*c*. Specifically, as shown in FIG. 11, the first joining surface 33*b* and the second joining surface 33*c* each may be configured as a rib-like portion that protrudes from the outer surface of the joining target portion 33. Here, a recess in the intermediate surface 33*a* with respect to the first joining surface 33*b* and the second joining surface 33*c* may be the reinforcing portion 33*d*.

In addition, the reinforcing portion 33*d* may be configured, for example, by increasing a plate thickness of the intermediate surface 33*a* or attaching a reinforcing member to the intermediate surface 33*a*, to thereby provide the joining target portion 33 with improved stiffness.

Further, in the first embodiment, the joining target portion 33 is formed in the curved portion in the upper side of each of the first end plate 31 and the second end plate 32. However, for example, the joining portion 33 may be similarly formed in a curved portion in an upper front side or an upper rear side of the shell 30. Further, the exhaust device 100 may, for example, support a pipe or the like that causes the exhaust gas to flow downstream. In this case, the joining target portion may be similarly formed in an upper side surface of the pipe or the like.

[7. Functions]

The reinforcing portion 33*d* is provided to the intermediate surface 33*a* between the first joining surface 33*b* and the second joining surface 33*c* of the joining target portion 33 that is provided to each of the first end plate 31 and the second end plate 32 of the muffler 3. As a result, the joining target portion 33 has improved stiffness. This can inhibit stress from being locally applied on the joining target portion 33. Further, as a result of improvement in stiffness of the joining target portion 33, the exhaust device 100 has an increased resonance frequency. Accordingly, the exhaust device 100 is less likely to resonate when the engine rotates at a high speed.

[8. Effects]

(1) According to the first embodiment, the reinforcing portion 33*d* is provided to the intermediate surface 33*a* between the first joining surface 33*b* and the second joining surface 33*c*. As a result, the joining target portion 33 has improved stiffness, which can inhibit stress from being locally applied on the joining target portion 33. This inhibits the joining target portion 33 from being damaged and/or from vibrating during travel of the vehicle. Further, as a result of improvement in stiffness of the joining target portion 33, the exhaust device 100 has an increased resonance frequency. Therefore, the exhaust device 100 is unlikely to resonate, which inhibits noise. Accordingly, it is possible to more advantageously support the muffler 3.

Further, the intermediate surface 33*a*, which is reinforced, is positioned between the first joining portion 14 and the second joining portion 15 of the bracket 10. This achieves a compact configuration that allows the intermediate surface 33*a* to be accommodated in an inner side of the bracket 10, thus seeking improvement in stiffness of the joining target portion 33.

(2) The first wall 12 and the second wall 13 of the bracket 10 are oblique such that the distance between the first wall 12 and the second wall 13 increases toward the opposite of the base 11. As a result, it is possible to improve stiffness of the bracket 10. Further, providing the first wall 12 and the second wall 13 with such obliqueness enables the first joining portion 14 and the second joining portion 15 to be configured to extend such that the distance between the first joining portion 14 and the second joining portion 15 increases from the respective first ends to the respective second ends of the first joining portion 14 and the second joining portion 15, the respective first ends being positioned closer to the base 11 than the respective second ends are. With this configuration, it is possible to further lengthen an area where each of the first joining portion 14 and the second joining potion 15, and the joining target portion 33 contact each other. Accordingly, it is possible to improve joining strength between each of the first joining portion 14 and the second joining portion 15, and the joining target portion 33.

(3) The reinforcing portion 33*d* protrudes out of the first joining surface 33*b* and the second joining surface 33*c*. The first joining surface 33*b* and the second joining surface 33*c* each are configured to be recessed in the outer surface of each of the first end plate 31 and the second end plate 32. The joining target portion 33 is configured as a curved surface. As a result, the joining target portion 33 has improved stiffness. Further, it is possible to configure the reinforcing portion 33*d* at a lower cost in a case where the reinforcing portion 33*d* is configured to protrude out of or to be recessed from the first joining surface 33*b* and the second joining surface 33*c*, in comparison with a case where the plate thickness of the intermediate surface 33*a* is increased or the intermediate surface 33 has a reinforcing member attached thereto.

Further, the first end plate 31 and the second end plate 32 each are curved to protrude outward at the center thereof along the up-down directions. Therefore, stiffness of the entirety of the first end plate 31 and the second end plate 32 is enhanced more than stiffness of a flat plate. And, the joining target portion 33 is provided to this curved portion in each of the first end plate 31 and the second end plate 32. Therefore, the joining target portion 33 has improved stiffness in comparison with a case where the joining target portion is provided to the flat plate.

(4) The first joining surface 33*b* and the second joining surface 33*c* each are configured to be recessed in the outer surface of each of the first end plate 31 and the second end plate 32. Therefore, respective shapes of the first joining surface 33*b* and the second joining surface 33*c* can be appropriately determined without being affected by the shape of the muffler 3. And, the first joining surface 33*b* and the second joining surface 33*c* each include the surface having the same or approximately the same shape as the reference shape. As a result, the first joining portion 14 and the second joining portion 15, each of which has the surface having the same or approximately the same shape as the reference shape, allows themselves contact the first joining surface 33*b* and the second joining surface 33*c*, respectively. Accordingly, it is possible to support a variety of exhaust component by the bracket 10, which corresponds to the reference shape and is standardized, without being affected by the shape of the exhaust member. This facilitates standardization of the supporting component 1. Particularly, determining the reference shape in a planar shape leads to standardization of the supporting component 1 without being affected by the degree of curvature of the joining surface of the exhaust component.

(5) The first joining portion 14 and the second joining portion 15 are shaped to be plane-symmetrical or approximately plane-symmetrical with each other with respect to the reference surface 10*c* as the center. The first wall 12 and the second wall 13 are shaped to be plane-symmetrical or approximately plane-symmetrical with each other with respect to the reference surface 10*c* as the center. As a result, the bracket 10 can be easily manufactured.

(6) The joining target portion 33 of the first end plate 31 is provided upward of the outlet 31*a*, which is provided with the burring 31*b*. As a result, the first end plate 31 has increased stiffness, which further improves stiffness of the joining target portion 33.

Second Embodiment

[9. Entire Configuration]

Figure 12:
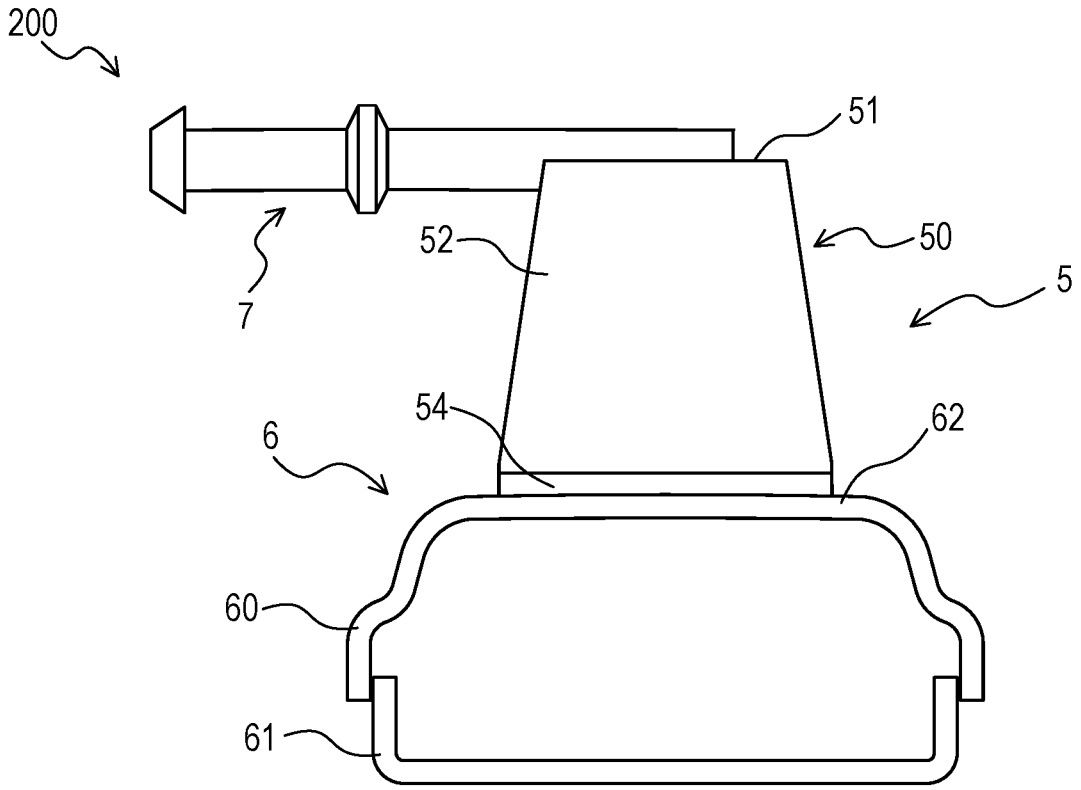
FIG. 12 is a side view of an exhaust device of a second embodiment.
Figure 13:
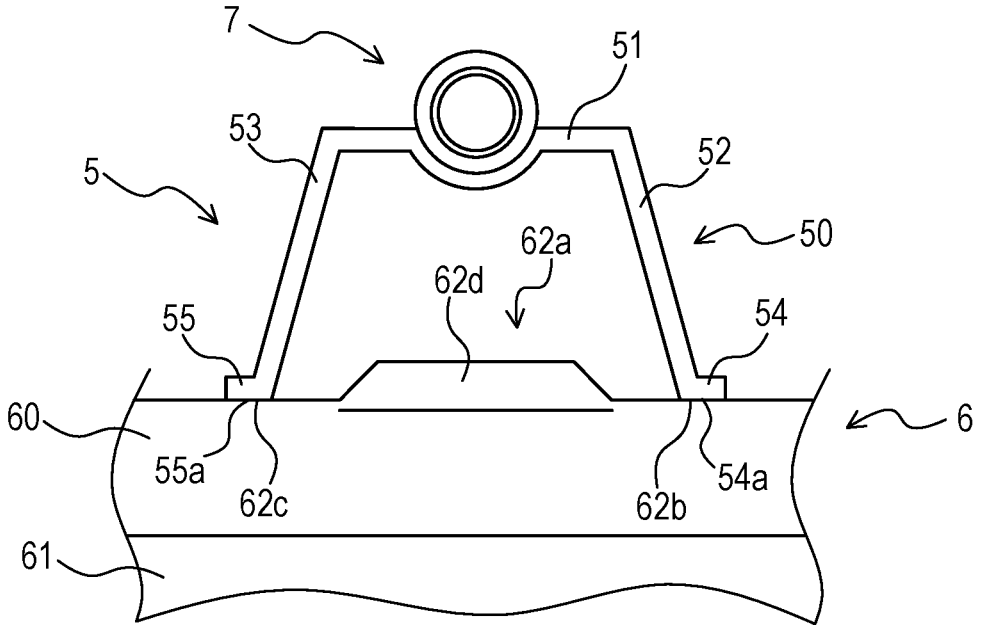
FIG. 13 is a front view of a portion of the exhaust device of the second embodiment, the portion being provided with a supporting component.

Next, descriptions are given to an exhaust device 200 of a second embodiment (see, FIGS. 12 and 13). In the exhaust device 100 of the first embodiment, the supporting component 1 is provided to the curved surface of the exhaust component. In the exhaust device 200 of the second embodiment, however, a supporting component 5 is configured to be provided to a planar or approximately planar surface in an upper outer surface of an exhaust component. In this respect, the second embodiment is different from the first embodiment. Hereinafter, descriptions are given to the exhaust device 200 of the second embodiment with focus on the difference between the second embodiment and the first embodiment.

[10. Respective Configurations of Muffler and Rod]

A muffler 6, which is one example of the exhaust component of the second embodiment, comprises an upper shell 60 and a lower shell 61 that are press-molded components (see, FIG. 12). Here, FIG. 12 shows a section of the muffler 6. The upper shell 60 and the lower shell 61 overlap and are joined together to form the muffler 6. The upper shell 60 is provided with a planar or approximately planar surface in an upper portion of the upper shell 60.

In the second embodiment, a bracket of the supporting component 5 is, as in the first embodiment, supported from above by a rod 7 that is joined to the bracket. However, the rod 7 of the second embodiment extends linearly and, in this respect, the rod 7 is different from the rod 2 of the first embodiment.

[11. Respective Configurations of Supporting Component and Exhaust Component]

The supporting component 5 supports the muffler 6 from above (see, FIGS. 12 and 13). Here, the supporting component 5 may support, from above, a component other than the muffler 6, such as a pipe or the like that is provided with a planar or approximately planar surface in an upper portion of the pipe or the like. The supporting component 5 comprises the rod 7 and a bracket 50 that is supported from above by the rod 7. Further, the muffler 6 comprises a joining target portion 62 that includes at least a portion of the upper shell 60.

As in the first embodiment, the bracket 50 comprises a base 51, a first wall 52, a second wall 53, a first joining portion 54, and a second joining portion 55.

The base 51 is a rectangular and flat plate-shaped portion. As in the first embodiment, the base 51 is provided with a groove 51*a* in an upper surface of the base 51. As in the first embodiment, the groove 51*a* is joined to (welded to, in one example) the rod 7. Here, in the second embodiment, the rod 7 is supported by a supporting rubber or the like in an extended state along the horizontal or approximately horizontal directions. Therefore, in the second embodiment, the bracket 50 is supported from above with the base 51 extending along the horizontal or approximately horizontal directions.

As in the first embodiment, the first wall 52 and the second wall 53 are flat plate-shaped portions that extend downward from respective edges of the base 51 that face each other. The first wall 52 and the second wall 53 each have a trapezoid shape.

The first joining portion 54 and the second joining portion 55 each have an elongated flat plate shape and are provided to respective lower edges of the first wall 52 and the second wall 53, respectively. The first joining portion 54 and the second joining portion 55 extend linearly. Here, respective planar or approximately planar surfaces positioned on the bottom of the first joining portion 54 and the second joining portion 55, respectively, are a contact surface 54*a* and a contact surface 55*a*. The first joining portion 54 and the second joining portion 55, respectively, are joined to (welded to, in one example) a first joining surface 62*b* and a second joining surface 62*c* of the joining target portion 62. When this joining occurs, the contact surface 54*a* of the first joining portion 54 and the contact surface 55*a* of the second joining portion 55, respectively, are brought into surface contact with the first joining surface 62*b* and the second joining surface 62*c* of the joining target portion 62.

The joining target portion 62 has a planar or approximately planar plate shape and is situated at the center of an upper surface of the upper shell 60. The joining target portion 62 comprises a first joining surface 62*b*, a second joining surface 62*c*, and an intermediate surface 62*a*.

The first joining surface 62*b* and the second joining surface 62*c* are elongated planar or approximately planar surfaces that are aligned with each other and extend in respective specific areas in an outer surface of the joining target portion 62. The first joining surface 62*b* and the second joining surface 62*c*, respectively, are joined to the contact surface 54*a* of the first joining portion 54 and the contact surface 55*a* of the second joining portion 55 of the bracket 50.

The intermediate surface 62*a* is a portion between the first joining surface 62*b* and the second joining surface 62*c*. The intermediate surface 62*a* is provided with a reinforcing portion 62*d* that reinforces the intermediate surface 62*a*. This improves stiffness of the joining target portion 62. In one example, the reinforcing portion 62*d* is configured as a rib-like portion that protrudes out of the first joining surface 62*b* and the second joining surface 62*c*. The reinforcing portion 62*d* may be provided in an area of the intermediate surface 62*a*, the area of the intermediate surface 62*c* extending from respective first ends of the first joining surface 62*b* and the second joining surface 62*c* to respective second ends of the first joining surface 62*b* and the second joining surface 62*c*.

[12. Effects]

According to the second embodiment, the joining target portion 62 of the muffler 6 has improved stiffness as in the first embodiment. As a result, it is possible to more advantageously support the muffler 6.

[13. Other Embodiments]

Figure 14:
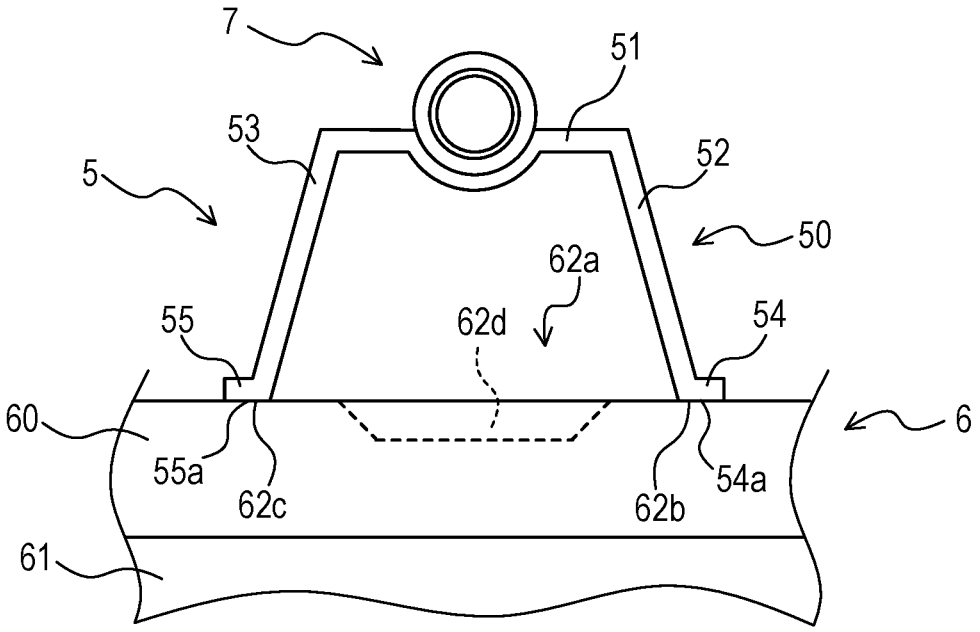
FIG. 14 is a front view of a portion of an exhaust device of a modified example, the portion being provided with a supporting component.
Figure 15:
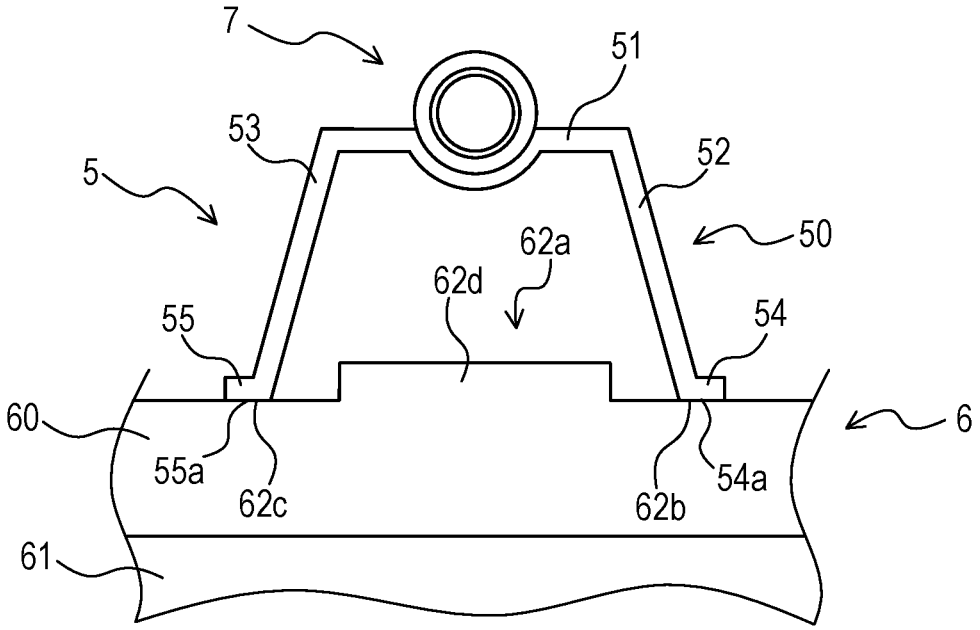
FIG. 15 is a front view of a portion of an exhaust device of another modified example, the portion being provided with a supporting component.
Figure 16:
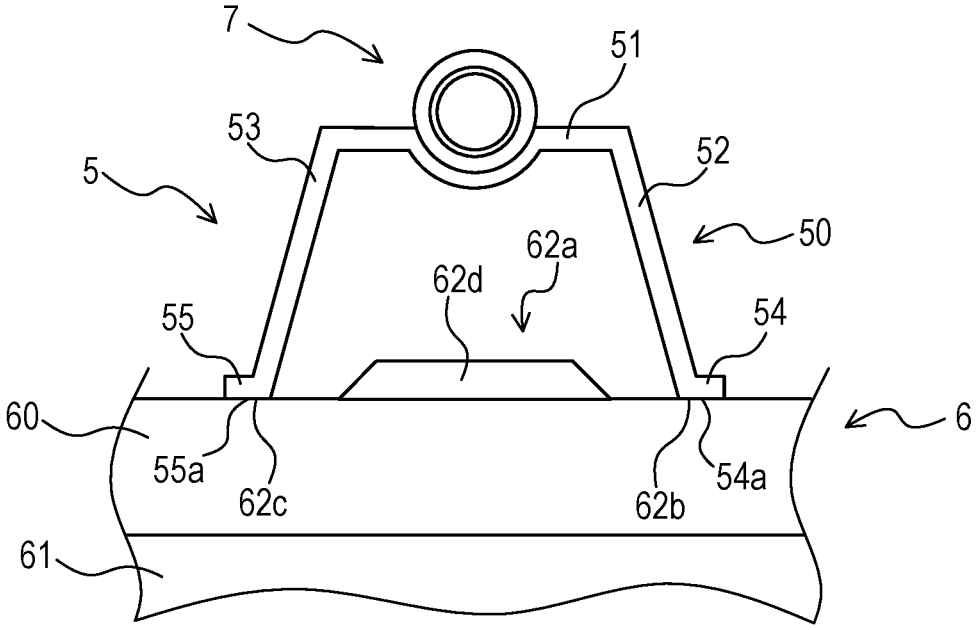
FIG. 16 is a front view of a portion of an exhaust device of still another embodiment, the portion being provided with a supporting component.

(1) In the exhaust device 200 of the second embodiment, the intermediate surface 62*a* is reinforced by the rib-like reinforcing portion 62*d*. However, the mode of the reinforcing portion 62*d* is not limited to the aforementioned. For example, as shown in FIG. 14, the reinforcing portion 62*d* may be shaped to be recessed from the first joining surface 62*b* and the second joining surface 62*c*. Further, as shown in FIG. 15, at least a portion of the intermediate surface 62*a* may have an increased plate thickness to form the reinforcing portion 62*d*, for example. Additionally, as shown in FIG. 16, at least a portion of the intermediate surface 62*a* may be provided with a reinforcement member to be used as the reinforcing portion 62*d*, for example.

(2) Functions of one element in the aforementioned embodiments may be achieved by two or more elements. One function of one element may be achieved by two or more elements. Functions of two or more elements may be achieved by one element. One function achieved by two or more elements may be achieved by one element. A part of the structures of the aforementioned embodiments may by omitted. At least a part of the structures of the aforementioned embodiments may be added to or replaced with other structures of another one of the aforementioned embodiments.

What is claimed is:

1. An exhaust device comprising:

an exhaust component that causes exhaust gas of a vehicle to flow downstream; and a supporting component that supports the exhaust component, wherein the supporting component includes:

a rod, which is a bar-shaped component, the rod being configured to be provided to the vehicle; and a bracket that is configured to be supported from above by the rod, wherein the exhaust component includes a joining target portion that includes:

a first joining surface and a second joining surface, each of which is a portion to which the bracket is joined in an outer surface of the exhaust component; and an intermediate surface that is provided between the first joining surface and the second joining surface, wherein the bracket includes:

a base, which is a plate-shaped portion, the base being configured to be joined to the rod;

a first wall and a second wall, each of which is a plate-shaped portion, the first wall and the second wall facing each other, and the first wall and the second wall each being configured to extend downward from the base, a first joining portion that is provided to an edge of the first wall and is joined to the first joining surface, a second joining portion that is provided to an edge of the second wall and is joined to the second joining surface, and wherein the intermediate surface includes a reinforcing portion that reinforces the intermediate surface.

2. The exhaust device according to claim 1, wherein the first wall and the second wall are oblique with respect to each other such that a distance between the first wall and the second wall increases toward the opposite of the base.

3. The exhaust device according to claim 1, wherein the first joining portion and the second joining portion each have an elongated plate shape, and wherein the first joining portion and the second joining portion extend such that a distance between the first joining portion and the second joining portion increases from respective first ends to respective second ends of the first joining portion and the second joining portion.

4. The exhaust device according to claim 1, wherein the reinforcing portion protrudes out of the first joining surface and the second joining surface.

5. The exhaust device according to claim 1, wherein the first joining surface and the second joining surface are recessed in the outer surface of the exhaust component.

6. The exhaust device according to claim 1, wherein the reinforcing portion is recessed from the first joining surface and the second joining surface.

7. The exhaust device according to claim 1, wherein the joining target portion has a curved plate shape.

8. The exhaust device according to claim 1, wherein a specified shape of a surface is determined as a reference shape, wherein the first joining surface and the second joining surface are recessed in the outer surface of the exhaust component, the first joining surface and the second joining surface each including a surface that has the same or approximately the same shape as the reference shape, wherein the first joining portion is joined to the first joining surface in a state where the first joining portion is brought into surface contact with the first joining surface, and wherein the second joining portion is joined to the second joining surface in a state where the second joining portion is brought into surface contact with the second joining surface.

9. The exhaust device according to claim 8, wherein the first joining portion and the second joining portion are shaped to be plane-symmetrical or approximately plane-symmetrical with each other with respect to a reference surface the reference surface being positioned between the first wall and the second wall, and wherein the first wall and the second wall are shaped to be plane-symmetrical or approximately plane-symmetrical with each other with respect to the reference surface.

10. The exhaust device according to claim 1, wherein the exhaust component is a muffler, and wherein the first joining surface and the second joining surface each are provided upward of an opening that communicates an inside of the muffler and an outside of the muffler together.

* * * * *